United States Patent [19]

Bowler

[11] 4,193,228

[45] Mar. 18, 1980

[54] WATER DRIVEN TOOL

[76] Inventor: Donald F. Bowler, 7942 Moorcroft Ave., Canoga Park, Calif. 91304

[21] Appl. No.: 862,030

[22] Filed: Dec. 19, 1977

[51] Int. Cl.[2] ..... B24B 23/02

[52] U.S. Cl. ..... 51/170 T; 15/1.7; 51/134.5 F; 51/267

[58] Field of Search ..... 51/170 R, 170 T, 134.5 F, 51/267; 15/1.7, 321, 385, 387

[56] References Cited

U.S. PATENT DOCUMENTS

| | | | |
|---|---|---|---|
| 1,858,043 | 5/1932 | Glass | 51/134.5 F |
| 2,077,693 | 4/1937 | Herrero | 51/134.5 F |
| 2,326,396 | 8/1943 | Schaedler | 51/134 F |
| 2,732,671 | 1/1956 | McFadden | 51/134.5 F |
| 3,110,993 | 11/1963 | Grage | 51/267 |
| 3,303,812 | 2/1967 | Sierra et al. | 15/1.7 |
| 3,928,947 | 12/1975 | Millett | 51/170 T |
| 3,961,449 | 6/1976 | Ise | 51/134.5 |
| 4,102,083 | 7/1978 | Stern | 51/134 F |

FOREIGN PATENT DOCUMENTS

| | | | |
|---|---|---|---|
| 1001515 | 10/1951 | France | 51/134.5 |

*Primary Examiner*—Othell M. Simpson
*Assistant Examiner*—Roscoe V. Parker
*Attorney, Agent, or Firm*—Huebner & Worrel

[57] ABSTRACT

A multi-purpose water driven tool, including a water driven turbine mounted on a shaft for rotation in a housing, the housing having an inlet connected to supply water under pressure to rotatably drive the turbine, a housing outlet to discharge the water from the housing after it has acted on the turbine, said shaft extending outwardly of the housing, and a working tool on the outer end of the shaft to be rotatably driven thereby.

6 Claims, 4 Drawing Figures

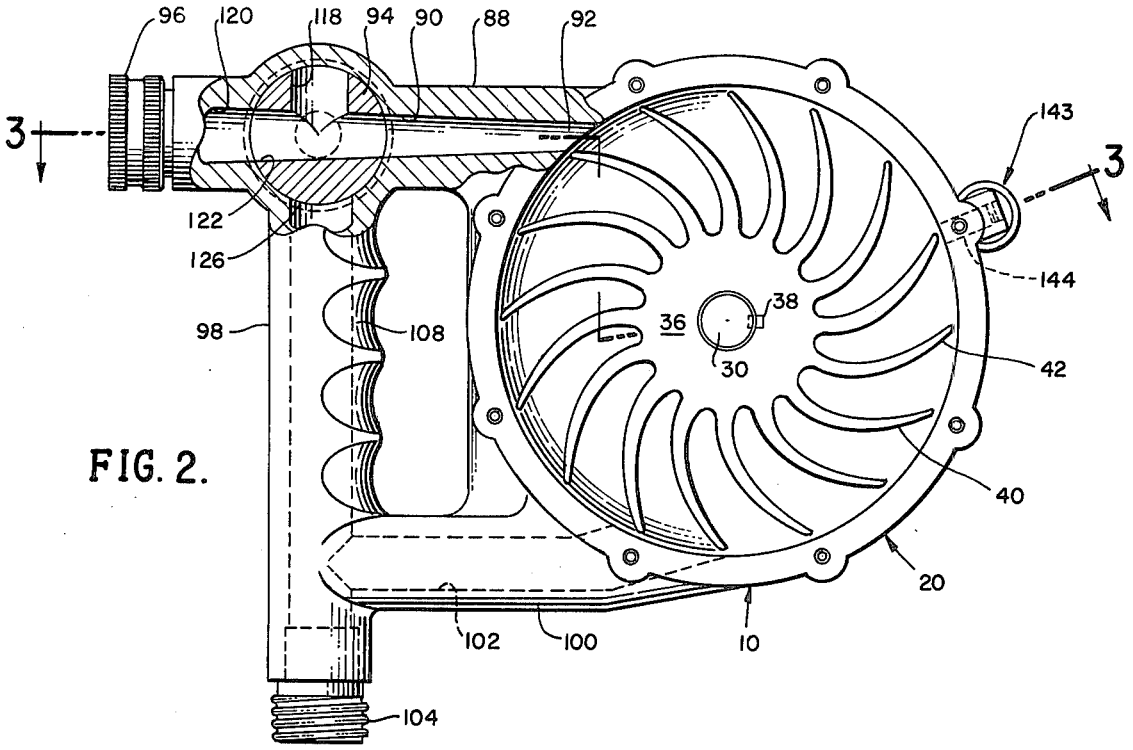
FIG. 2.
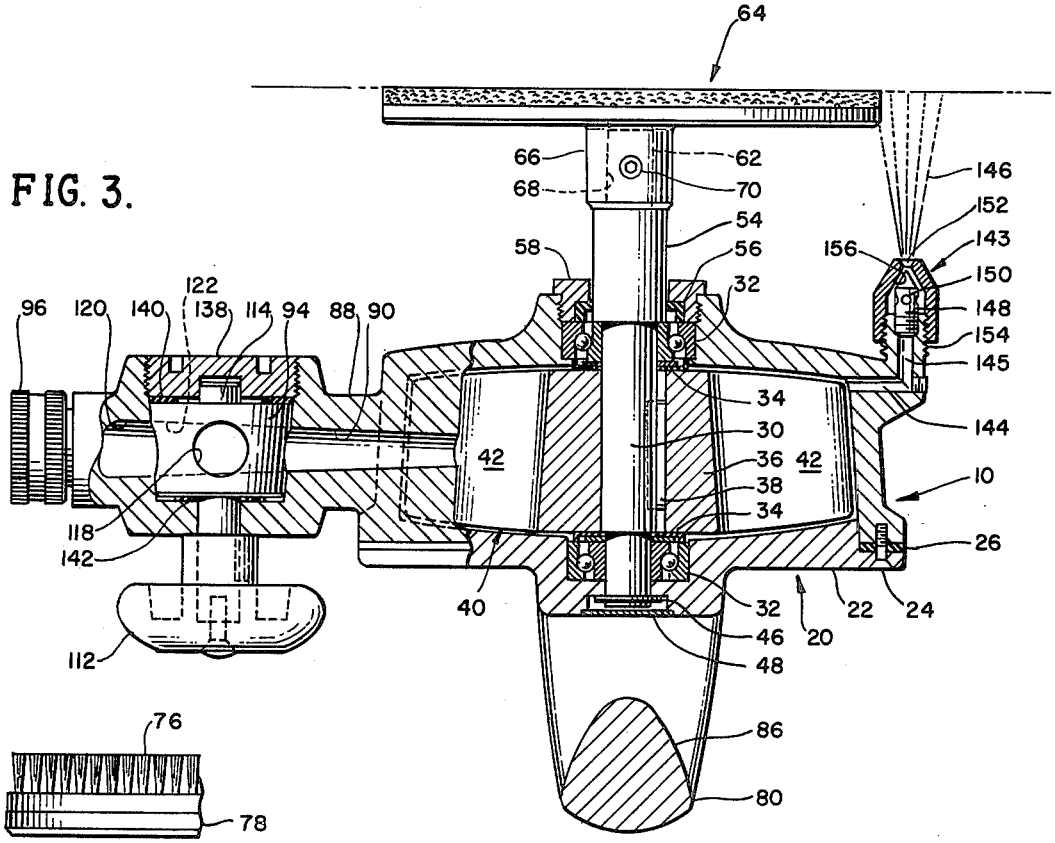
FIG. 3.
FIG. 4.

WATER DRIVEN TOOL

BACKGROUND OF THE INVENTION

The invention relates to a water driven tool particularly suitable for use in or near swimming pools, stall showers, boat yards and docks, and other places where the presence of water limits or makes hazardous the use of electrically driven tools.

In the prior art swimming pool cleaning tools, typically the tools are operated by suction created in the pool filter system. The present invention utilizes direct pressure not suction. Thus, the tool operates at a high speed and is not a slow moving vacuum cleaning device.

SUMMARY OF THE INVENTION

The invention is a hand tool for operation on wet surfaces or near wet surfaces, and may be used for sanding, buffing, brushing, polishing, drilling, and cleaning surfaces and objects, including tile and other surfaces normally found in swimming pools or showers, for example.

The tool includes an enclosed turbine or impeller driven at high speed by water under pressure and which in turn drives a working tool attached externally to the turbine shaft.

Accordingly, it is an object of the invention to provide an improved hand tool for use when electrically operated tools are not safe.

It is another object of the invention to provide a water driven hand tool operable by connection to a garden hose attached to a yard faucet.

It is still another object of the invention to provide a hand tool, as described in the preceding paragraph, to which a working tool, such as an abrading or cleaning disc, or drill may be attached and driven thereby.

It is a further object of the invention to provide a hand tool, as described in the preceding paragraphs, having a threeway valve attached to the water inlet. The valve in its normally open position permits water to enter the housing to drive the turbine. In a second position it by-passes the water away from the housing, and in a third position shuts off the water to the housing.

It is a still further object of the invention to provide a hand tool, as described in the preceding paragraphs, in which a by-pass pipe is positioned to form a holding handle.

It is another object of the invention to provide a hand tool, as described in the previous paragraphs, having a valve-controlled nozzle for spraying water on the surface on which the work is being done.

It is still another object of the invention to provide a hand tool, as described in the preceding paragraphs, that is operated at high speed by direct water pressure.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to the accompanying drawings, which are for illustrative purposes:

FIG. 2 is a cross-sectional elevational view of the tool illustrating the interior;

FIG. 3 is a cross-sectional plan view of the tool, taken substantially along the lines 3—3 in FIG. 2; and FIG. 4 is a fragmentary view of a cleaning brush to be driven by the tool.

DESCRIPTION OF THE PREFERRED EMBODIMENT

Figure 1:
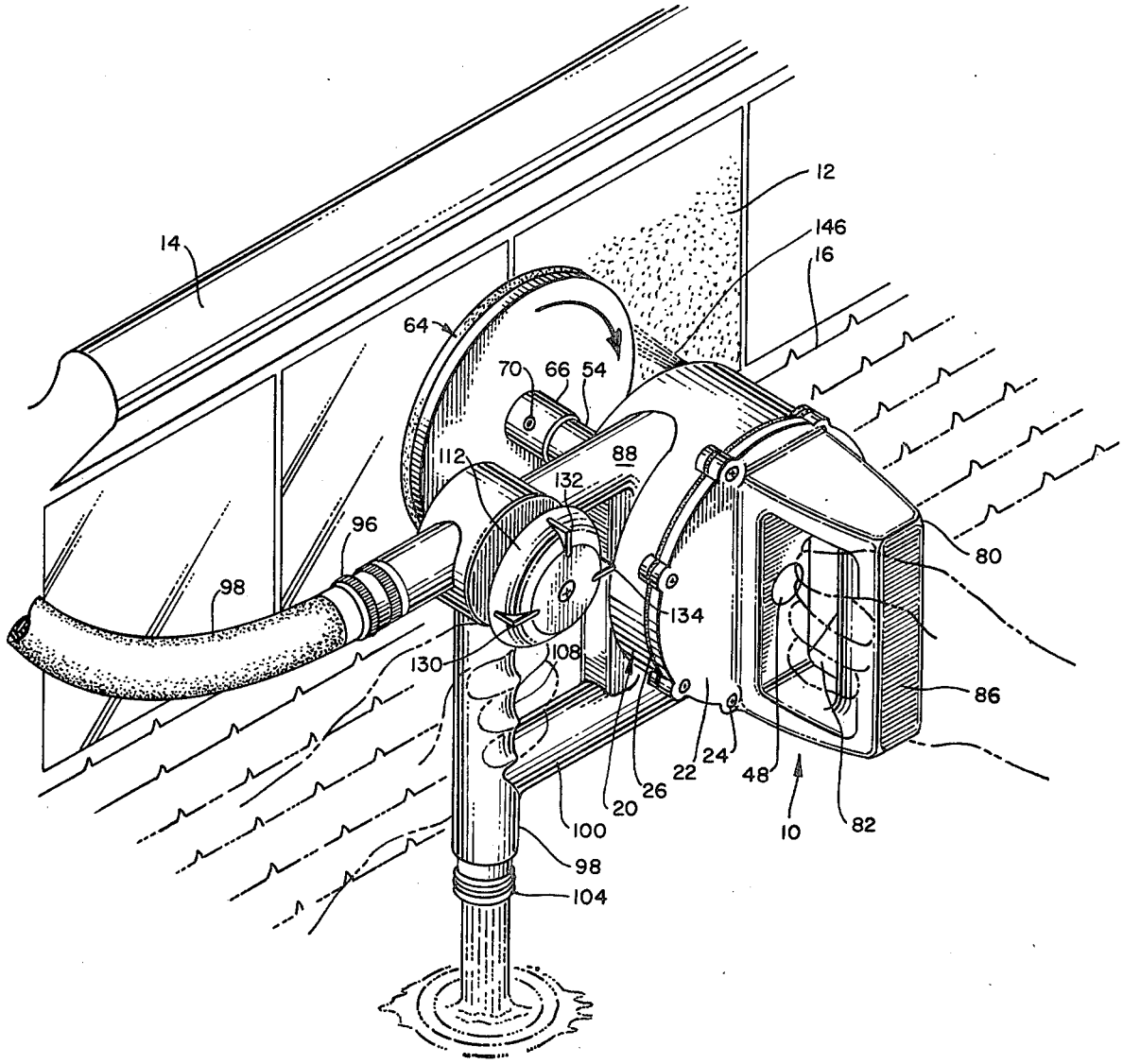
FIG. 1 is a perspective view of the water driven hand tool, according to the invention, in an operating position.

Referring again to the drawings, there is shown in FIG. 1 a water driven hand tool, generally designated as 10, in operation, cleaning an upper wall 12 of a swimming pool 14 adjacent the water line 16.

As shown in FIGS. 1—3, the tool or device 10 is formed of a generally cylindrical housing 20, sealed by closure plate 22. The plate is secured to the housing by circumferentiallyspaced screws 24, a gasket 26 being spaced between the housing proper and the plate to form a seal.

A turbine shaft 30 is mounted for rotation in the housing on bearings 32 at each end. Surrounding the shaft inwardly of the bearing are seals 34. Fitted on the shaft is a turbine hub 36, mounted for rotation to drive the shaft by means of a spline 38 extending into hub and shaft. Extending radially outwardly from the hub 36 is a turbine wheel 40 comprised of vanes 42.

The outer end of the shaft 30 is held in place by a snap ring 46 and the housing opening outwardly of the shaft is closed by a disc 48. At the other end of the shaft there is an external large diameter portion 54 surrounded by a packing ring 56 in abutment with the bearings and held in place by a gland 58. The outer end of the shaft 62 is reduced in size and adapted to receive working tools, such as the abrading tool 64. the abrading tool has a cylindrical connecting member 66 having an opening 68 adapted to fit on the shaft end 62 and is held in place by an Allen screw 70.

Additional types of coupling members 66 may be attached to the outer end 62. For example, a drill chuck may be used so that the working tool may be a drill bit. The abrading tool, such as 64, may be of various types, such as a brush 76 mounted on a disc 78 having a connecting means 66. The type of abrading surface used will depend upon the work to be done. The materials on the disc may be sandpaper, a soft wool polishing or buffing material, or a wire surface for cleaning rough surfaces. Typically for cleaning a polished tile a brush may be used so as to not remove the finish. Detergents or cleaning powders may be used to aid in cleaning as necessary. A dispenser for cleaning materials may be attached to the tool in a container provided on the housing 20.

At the outer end of the closure plate 20 is a handle 80 by which the operator may hold the tool during the working process. The handle 80 has an opening 82 into which the fingers may be fitted to grasp the holding member 86.

The turbine 40 is driven by water through an inlet tube 88 which has a converging passage 90 having a relatively small inner end 92 to increase the pressure as the water strikes the vanes 42 with a maximum pressure to rotate the turbine. The tube 88 has a three-way valve 94 therein and in FIGS. 2 and 3 the valve is shown in the open position to the turbine. The water connection at the outer end of the inlet is a typical garden hose coupling 96 to which a garden hose 98 may be connected, as shown in FIG. 1. Extending downwardly from the tube 88 is a discharge and by-pass pipe 98. Connected to the pipe 98, adjacent its lower end, is turbine discharge outlet tube 100 having a passage 102 through which the water flows after it has acted on the turbine. During normal operation the water is discharged through the pipe 98 at its lower end 104, as shown in FIG. 1. The outlet passage 102 and the lower end 104 are larger than the inlet 90, 92 so that back pressure is prevented from developing in the turbine. Where a swimming pool or tile shower is being cleaned the water may be permitted to drain directly into either one without an additional connection. Where the water is not free to drain directly in the environment of the operation, a hose may be connected to the threads on the end 104 for discharge elsewhere. The pipe 98 has cutaway portions 108 so that they may be gripped with the fingers of the hand, not on the handle 80, and thus the by-pass pipe serves as an additional handle.

The valve is rotated by means of a handle 112, the handle being attached to a valve stem 114, as shown in FIG. 3. When it is desired that the water be shut off from the passage 90 and from the turbine so as to not rotate it, the valve may be turned 90° to the left, FIG. 2, whereby valve passage 118 is open to the main inlet passage 120, and valve passage 122 is open to by-pass 98. Thus, the water will flow through passage 120, 118 and 122 and out of the end 104. Because the passage in the by-pass is larger than the discharge tube 102 the water will flow out of end 104 and not into the turbine outlet. If necessary, a check valve could be installed in passage 102 to prevent the flow of water into the outlet.

In order to close the valve 94 completely to the turbine it may be rotated 90° to the right so that its lower cylindrical portion 126 fits over the passage 120 and forms a seal. As shown in FIG. 1, the valve handle has three tabs 130, 132 and 134 to indicate the direction of flow. When the tabs 130 and 134 are in alignment with the passage 90 then water flows into the turbine. When the tabs 130 and 132 are rotated 90° to the left, the water flows from the passage 120 through the by-pass. When the valve handle is rotated 90° to the right, the omission of a tab indicates that the valve is closed and there is no flow.

As shown in FIG. 3, the valve is held in place by a threaded disc 138 in which the valve stem 114 rotates. Seals 140 and 142 are provided on opposite sides of the valve.

As best seen in FIGS. 2 and 3, a spray nozzle 143 is connected to the turbine by means of passages 144 and 145 to provide a water spray 146 onto a working surface when it is desired. The nozzle has an inner conical ended member 148 having discharge holes 150 which supply the water from the passage 145 to the nozzle opening 152. The nozzle 143 is closed by rotating it on threads 154 downwardly so that a nozzle inner conical surface 156 closes on the conical end on the member 148. In addition to water, cleaning materials, such as detergents, may be injected into the turbine and discharged through the nozzle 143 is desired.

In operation the tool 10 provides an excellent water-powered device which may be used with safety in any wet environment where an electrically operated tool would not be safe. The tool is designed so that a typical garden hose connected to an outdoor faucet may operate a working tool, such as the disc 64, at a high rotary speed.

The invention and its attendant advantages will be understood from the foregoing description and it will be apparent that various changes may be made in the form, construction and arrangements of the parts of the invention without departing from the spirit and scope thereof or sacrificing its material advantages, the arrangements hereinbefore described being merely by way of example. I do not wish to be restricted to the specific form shown or uses mentioned except as defined in the accompanying claims, wherein various portions have been separated for clarity of reading and not for emphasis.

I claim:

1. A water driven hand tool, comprising:
a water driven turbine,
a turbine housing enclosing said turbine,
a turbine shaft mounted for rotation in said housing,
said turbine being mounted on said shaft for rotation therewith,
a housing inlet connected to supply water under pressure to rotatably drive the turbine,
a housing outlet to discharge said water from said housing after it has acted on said turbine,
an external shaft connected to said turbine shaft to rotate therewith,
tool means on the end of the external shaft to be rotated thereby,
a valve in said inlet to open and close the inlet to the housing, and
a by-pass pipe connected to said inlet and to said valve, said by-pass pipe having a discharge connected to said housing outlet downstream of said valve and said inlet,
said valve in a first position being operable to supply water to said housing through said inlet and to shut off water to said by-pass pipe,
said valve in a second position being operable to shut off water to said inlet to said housing and to discharge water through said by-pass pipe,
said valve in a third position being operable to shut off water to said housing and said by-pass pipe,
said outlet being connected to said by-pass pipe so that during normal operation of said turbine, when said valve is in said first position, said water discharges through said by-pass discharge.

2. The invention according to claim 1 including:
a first handle on said housing on a side thereof opposite said tool means, said first handle being generally perpendicular to said shafts,
said by-pass pipe extending along said housing transverse to said shafts to form a second handle for holding said too, said second handle extending between said inlet and said outlet.

3. The invention according to claim 2 in which:
the outlet and by-pass pipe are larger than the inlet so as to prevent the development of back pressure in the turbine.

4. The invention according to claim 2 in which:
said valve is adjacent the end of second handle,
said second handle being downstream of said valve and upstream of said by-pass discharge.

5. The invention according to claim 4 in which:
said housing has a spray nozzle directed to spray water therefrom past said tool means,
said nozzle having an adjustable valve thereon to regulate the flow therefrom and to shut off the flow.

6. The invention according to claim 1 in which:
the outlet is larger than the inlet so as to prevent the development of back pressure in the turbine.

* * * * *